United States Patent [19]

Konig

[11] Patent Number: 4,719,745

[45] Date of Patent: Jan. 19, 1988

[54] TEXTURIZING MACHINE FOR FALSE-TWIST CRIMPING OF SYNTHETIC YARNS

[75] Inventor: Gunter Konig, Uhingen-Baiereck, Fed. Rep. of Germany

[73] Assignee: Zinser Textilmachinen GmbH, Fed. Rep. of Germany

[21] Appl. No.: 8,742

[22] Filed: Jan. 30, 1987

[30] Foreign Application Priority Data

Feb. 1, 1986 [DE] Fed. Rep. of Germany ..... 3603058
Dec. 3, 1986 [DE] Fed. Rep. of Germany ..... 3641212

[51] Int. Cl.[4] ..... D02G 1/02; D02G 1/20

[52] U.S. Cl. ..... 57/291; 57/284; 57/290

[58] Field of Search ..... 57/284–289, 57/290–292

[56] References Cited

U.S. PATENT DOCUMENTS

| | | | |
|---|---|---|---|
| 3,165,881 | 1/1965 | DeMoncuit et al. | 57/291 |
| 3,950,928 | 4/1976 | Murakami et al. | 57/291 |
| 3,962,829 | 6/1976 | Schippers | 57/291 |
| 4,024,697 | 5/1977 | Bucher et al. | 57/291 X |
| 4,051,650 | 10/1977 | Gleyze et al. | 57/291 |
| 4,362,010 | 12/1982 | Crouzet | 57/291 X |
| 4,395,872 | 8/1983 | Riedl | 57/291 |

FOREIGN PATENT DOCUMENTS 3400767 7/1984 Fed. Rep. of Germany .

*Primary Examiner*—John Petrakes

*Attorney, Agent, or Firm*—Shefte, Pinckney & Sawyer

[57] ABSTRACT

A texturizing machine for false-twist crimping of synthetic yarns having a plurality of work stations at each of which yarn is drawn by feed rolls from supply bobbins and guided successively through a heating device, a cooling device and a texturizing unit to a group of superjacent bobbin winding units, with the bobbin winding unit groups being arranged in longitudinal succession along the length of the machine. A pair of opposed spaced longitudinaly extending support frames define an operator service passageway therebetween. The heating devices, cooling devices and texturizing units are disposed adjacent the passageway with the yarn being guided over the passageway. The bobbin winding units are mounted on the opposed frames on both sides of the passageway with the groups of bobbin winding units alternately mounted successively on opposite frames longitudinally of the machine with the yarns of successive bobbin winding unit groups being guided in opposite directions over the passageway. The heating devices, cooling devices and texturizing units for successive bobbin winding unit groups are arranged in reverse order. In one embodiment the supply bobbins are mounted on the frames opposite the frames on which their associated bobbin winding unit groups are mounted. In another embodiment the bobbins are mounted on movable creels in the passageway and extend to the frames and then across the passageway to the opposite frames at which the associated bobbin winding units are located.

27 Claims, 8 Drawing Figures

Fig. 7
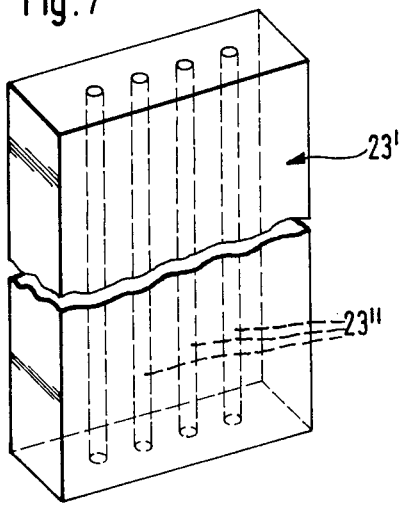
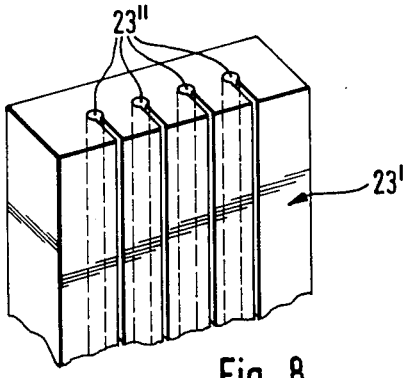
Fig. 8

TEXTURIZING MACHINE FOR FALSE-TWIST CRIMPING OF SYNTHETIC YARNS

BACKGROUND OF THE INVENTION

The present invention relates to a texturing machine for false-twist crimping of synthetic yarns having a plurality of work stations at each of which yarn is drawn by feed rolls from supply bobbins and guided successively through a heating device, a cooling device and a texturing unit to a group of superjacent bobbin winding units, with the bobbin winding unit groups being arranged in longitudinal succession along the length of the machine, and wherein the yarns are guided over an operator service passageway defined by two support frames adjacent which passageway the heating devices, cooling devices and the texturizing units are located.

A texturizing machine of this general type is known from German DE-OS No. 34 00 767, which discloses a creel containing several superjacent supply bobbins from which the yarns are drawn with the aid of a first feed roll and fed to vertically directed heating tracks. Then, the yarns are deflected by deflecting rolls or the like at an acute angle and guided along cooling plates to the texturizing units, which impart a twist to the yarns. Bobbin winding units are arranged in superjacent relation in a frame approximately parallel to and opposite the creel and to which bobbin winding units the yarns are guided from second feed rolls. Superjacent bobbin winding units form a group, so that the number of groups which are adjacent to each other in the longitudinal direction of the machine determines the length of the texturizing machine.

It is also known that this prior design can be used in a machine arranged with two laterally spaced creels of supply bobbins and with the bobbin winding unit groups on a central frame between the creels. This produces two passageways divided by the central frame.

The operation and maintenance of this known texturizing machine requires auxiliary means, such as, for example, a stand to clean the heating tracks so that the operator can reach the entire vertically positioned heating track. It is also not possible, due to the distribution of the work devices, for the operator to survey all work stations of the texturizing machine at the same time. Further, the operator may have long work paths between two work stations located in different passageways as a result of the two non-connected passageways.

SUMMARY OF THE INVENTION

The present invention provides a texturizing machine capable of improved operation and maintenance with the ability for an operator to survey all work stations at the same time.

Briefly described, the texturizing machine for false-twist crimping of synthetic yarns of the present invention is of the type having a plurality of work stations at each of which yarn is drawn by feed rolls from supply bobbins and guided successively through a heating device, a cooling device and a texturizing unit to a group of superjacent bobbin winding units, with the bobbin winding unit groups being arranged in longitudinal succession along the length of the machine. The machine includes a pair of opposed spaced longitudinally extending support frames defining an operator service passageway therebetween, with the heating devices, cooling devices and texturizing units disposed adjacent the passageway and with the yarn being guided over the passageway. The bobbin winding units are mounted on the opposed frames on both sides of the passageway with the groups of bobbin winding units being mounted in longitudinal sequence with successive bobbin winding unit groups being alternately mounted on opposite frames and with the yarns of successive bobbin winding unit groups being guided in opposite directions over the passageway and successively through said heating devices, cooling devices and texturizing units. The heating devices, cooling devices and texturizing units for successive bobbin winding unit groups are arranged in opposite order to accommodate the opposite guiding of the yarns.

As a result of the arrangement of the bobbin winding units in both frames, they can be surveyed from the passageway located between them. This makes it possible to survey all work stations of the texturizing machine at the same time. Similarly, all work stations can be maintained and operated by an operator from the same passageway without special auxiliary means being necessary.

In one embodiment, the bobbin winding units of the two frames are positioned in the longitudinal direction of the machine so that each group of bobbin winding units partially overlaps the next longitudinally successive bobbin winding unit group. This reduces the space required by the machine.

In one preferred embodiment the supply bobbins are mounted in both of the two frames, with the supply bobbins for each group of bobbin winding units mounted on the frame opposite the frame on which the associated group of bobbin winding units is mounted. This achieves an even distribution of the bobbin winding units and supply bobbins on the two frames.

Preferably, the supply bobbins are located on the sides of the frames facing away from the operating passageway. This makes possible a simple exchange of the supply bobbins from the outside.

In another development of the invention, the supply bobbins are located on movable creels in the operator service passageway and the yarns are first guided from the supply bobbins on the creels to the side of the operating passageway opposite the associated bobbin winding unit groups and subsequently over the operating passageway to the bobbin winding groups. In this arrangement, the supply bobbins can be exchanged from inside the passageway and the sides of the two frames facing away from the passageway need not be accessible.

It is also possible in this embodiment to perform the exchange of wound bobbins from the outer side facing away from the passageway, which has the advantage that this exchange does not have to be performed through the running yarn. This represents a particular advantage for an exchange by means of automatic doffing equipment.

In any of the embodiments of the invention the heating device, the cooling device and the texturizing unit of each work station are preferably located at least approximately in a linear series. This enables the twist imparted by the texturizing units to the yarns to act in a substantially unimpeded manner into the area of the heating devices, so that an optimum texturizing of the yarns is possible.

Preferably, the heating devices, the cooling devices and the texturizing units are aligned approximately horizontally so that they are within relatively easy reach of an operator without stands or the like being necessary for operation and maintenance.

If desired, the machine of the present invention may incorporate heatsetting units positioned in a spatially advantageous manner and readily accessible. This is achieved by the heatsetting units being located following the texturizing units in the run of the yarns, with the heatsetting units located on the frames on both sides of the passageway and arranged generally vertically. This vertical arrangement of the heatsetting units on the frames on both sides of the passageway achieves a spatially advantageous location within the texturizing machine.

These heatsetting units are preferably disposed facing the passageway and between the groups of superjacent bobbin winding units, which renders the bobbin winding units and the heatsetting units readily accessible for an operator in the passageway. Preferably, the yarns for each group of bobbin winding units are associated with a common heatsetting unit for efficient and compact operation.

Other features and advantages of the invention are illustrated in the accompanying drawings and described in the following description.

BRIEF DESCRIPTION OF THE DRAWINGS

FIG. 7 is an enlarged perspective view of a heatsetting unit of the embodiment of FIGS. 5 and 6; and FIG. 8 is a view similar to that of FIG. 7 of a heatsetting unit with slotted tubes.

DETAILED DESCRIPTION OF THE PREFERRED EMBODIMENTS

Figure 1:
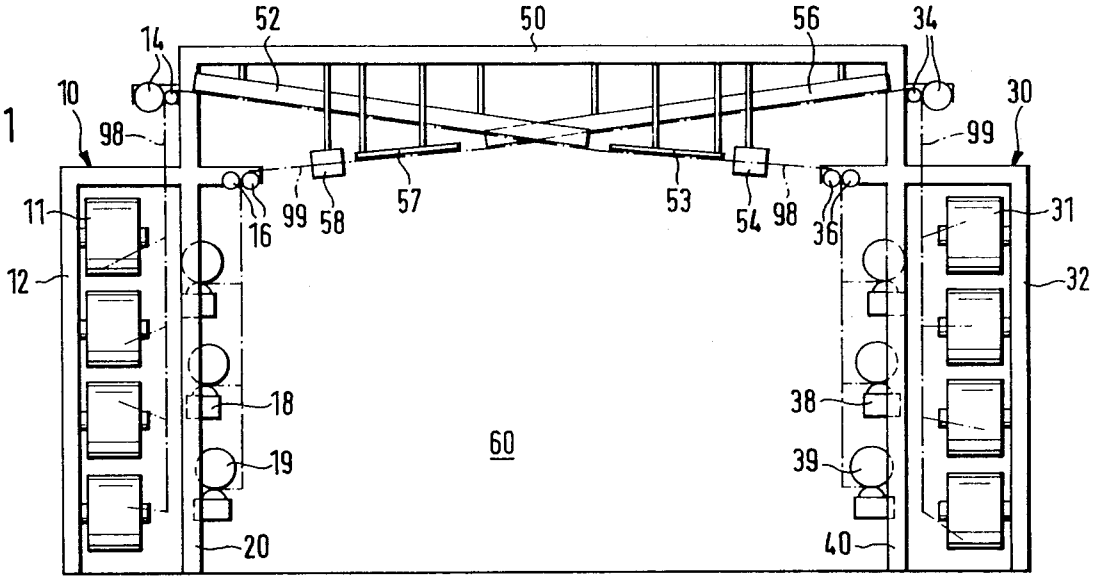
FIG. 1 is a schematic front elevation of a first embodiment of a texturizing machine in accordance with the present invention.
Figure 2:
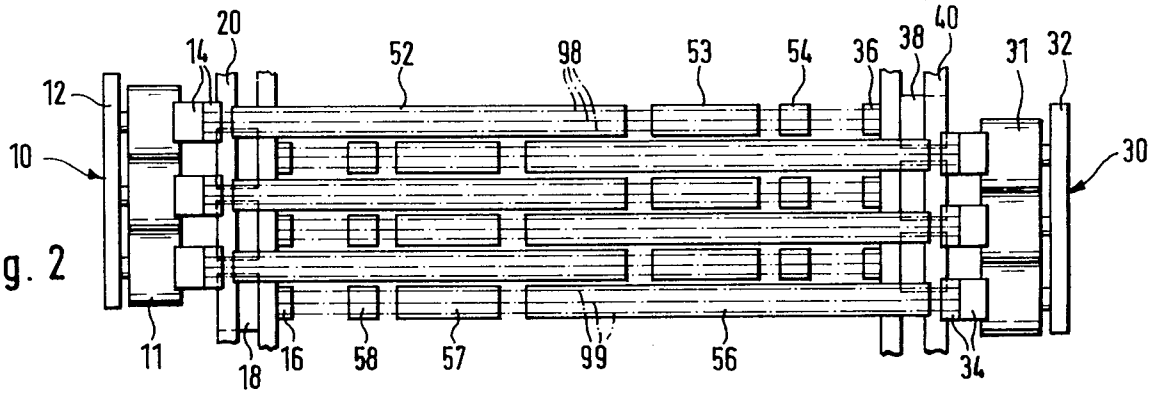
FIG. 2 is a plan view of the texturizing machine of FIG. 1.

In the texturizing machine for the false-twist crimping of synthetic yarns of the embodiment of FIGS. 1 and 2, a pair of opposed spaced longitudinally extending support frames 10 and 30 define an operator service passageway 60. Both frames 10,30 are aligned approximately parallel to one another and are approximately 2 m to 2.5 m high and approximately 1.2 m wide. The width of the passageway 60 can be varied, as will be explained; however, it is usually not less than approximately 2.5 m.

The frames 10,30 consist generally of grids 12,32 that form sides for the frames facing outwardly away from the passageway 60 for mounting supply bobbins 11,31, and of carriers 20,40 located near the passageway 60 for receiving bobbin winding units 18,38 for winding bobbins 19,39. Several bobbin winding units 18,38 are located over each other. Their number is a function of the desired height of the frames 10,30 and of the height of the bobbin winding units 18,38. The bobbin winding units located superjacent in a row over each other 18,38, the number of which is usually between 3 and 5, form a group. The individual groups are lined up in a row in the longitudinal direction of the texturizing machine, which determines, as a function of the desired number of work stations of the texturizing machine, the length of the machine. The total number of bobbin winding units 18,38, which corresponds to the desired number of work stations of the texturizing machine, is usually distributed evenly on the two frames 10,30.

In FIG. 2 the successive groups of winding units 18,38 of the two frames 10,30 overlap each other. Preferably, the bobbin winding units 18 of the left frame 10 are offset by approximately one half their extent in the longitudinal direction of the texturizing machine in relation to the units on the right frame 30. The supply bobbins 11 of the left frame 10 are associated with the bobbin winding units 38 of the right frame 30 and the bobbin winding units 18 of the left frame 10 are associated with the supply bobbins 31 of the right frame 30, such that the winding unit groups alternate longitudinally on each frame with the supply bobbins. Also, the supply bobbins 11,31 and the bobbin winding units on each frame are offset in relation to each other transversely to the longitudinal direction of the machine.

According to FIG. 1, a crossbeam 50 connected to the carriers 20,40 is located between the frames 10,30 over the passageway 60. While the carriers 20,40 are vertically arranged, the crossbeam 50 extends in a horizontal direction. First feed rolls 14,34, second feed rolls 16,36, heating tracks 52,56, cooling plates 53,57 and texturizing units 54,58 are attached to the crossbeam 50. The heating tracks 52,56 as well as the cooling plates 53,57 are slightly inclined to the horizontal by approximately the same angle. As can be seen in FIG. 2, the supply bobbins 11, for an associated group of winding units 38 and the associated first feed rolls 14, heating track 52, cooling plate 53, texturizing unit 54, and second feed rolls 36 form a work station for the yarns 98. An analogous situation applies to the adjacent set of supply bobbins 31, first supply roll 34, heating track 56, cooling plate 57, texturizing unit 58, second feed rolls 16 and bobbin winding units 18, which are positioned in the reverse order and in which the yarns 99 run in the opposite direction. The yarns 98,99 run counter to each other in groups and cross each other over the passageway 60. The heating tracks 52,56, cooling plates 53,57 and texturizing units 54,58 of each of the successive groups are positioned in reverse order. Thus, the supply bobbins for each group are mounted on the frame opposite the frame on which the associated yarn winding unit group is mounted with the yarn winding unit groups alternating longitudinally with supply bobbins on each frame.

The yarns 98,99 are heated by the heating tracks 52,56 to a temperature in the range of approximately 140° to approximately 230° C. Then, the yarns 98,99 are cooled down by the cooling plates 53,57 to a temperature of approximately 90° C. so that they can be texturized with the following texturizing units 54,58 with no danger of yarn damage. The texturizing units 54,58 apply false-twist to the yarns 98,99, which runs back into the area of the heating tracks 52,56, where the false-twist produces a permanent deformation in the yarns 98,99 due to the heating.

In order to heat the yarns 98,99 to the specified temperatures, the lengths of the heating tracks 52,56 are dimensioned as a function of the yarn speed, the yarn material and the yarn thickness. The length of the cooling plates 53,57 should be dimensioned in a corresponding manner. In the texturizing machine of FIGS. 1 and 2, the heating tracks 52,56, the cooling plates 53,57 and the texturizing units 54,58 form straight, essentially horizontal, yarn guides for the yarns 98,99 so that the width of the passageway 60 is a function of the lengths of the heating tracks 52,56 and the lengths of the cooling plates 53,57 plus the length of the texturizing units 54,58.

In order to obtain a sure lie of the yarns 98,99 on the heating tracks 52,56, which guide the yarns 98,99 with their bottom in the embodiment shown, the tracks are slightly arched in accordance with yarn sag. The yarns 98,99 associated with each group of bobbin winding units 38,18 are guided over a common heating track 52,56. Likewise, common cooling plates 53,57 are provided for each group. If desired, the heating tracks may be arranged for guiding the yarn on the top of the heating tracks 52,56.

All bobbin winding units 18,38 located adjacent each other in a horizontal row are driven by a drive motor (not shown) by a through shaft. An analogous situation applies to the feed rolls that are linearly adjacent in the direction of yarn travel on each frame. All elements of the individual groups which have the same function have the same rpm or speed by means of appropriate couplings, e.g. by means of the use of synchronous motors and by means of their electronic control with a common frequency in a conventional manner (not shown). The texturizing units 54,58 are provided with individual motors which run by means of couplings with the same speed. The winding bobbins 19,39 are replaceable and can be changed from the passageway 60 by an operator or by appropriately automated devices. The supply bobbins 11,31 are accessible for a bobbin change from the sides of the two frames 10,30 which face away from the passageway 60. It is possible to combine several supply bobbins in a common, traveling grid which can be replaced by an operator or by an automatic device.

As a result of the dimensions of the entire texturizing machine, all elements, especially those located over the passageway 60, can be reached by an operator without additional auxiliary means. Moreover, all work stations of the texturizing machine can be surveyed from any spot in the passageway 60.

Figure 3:
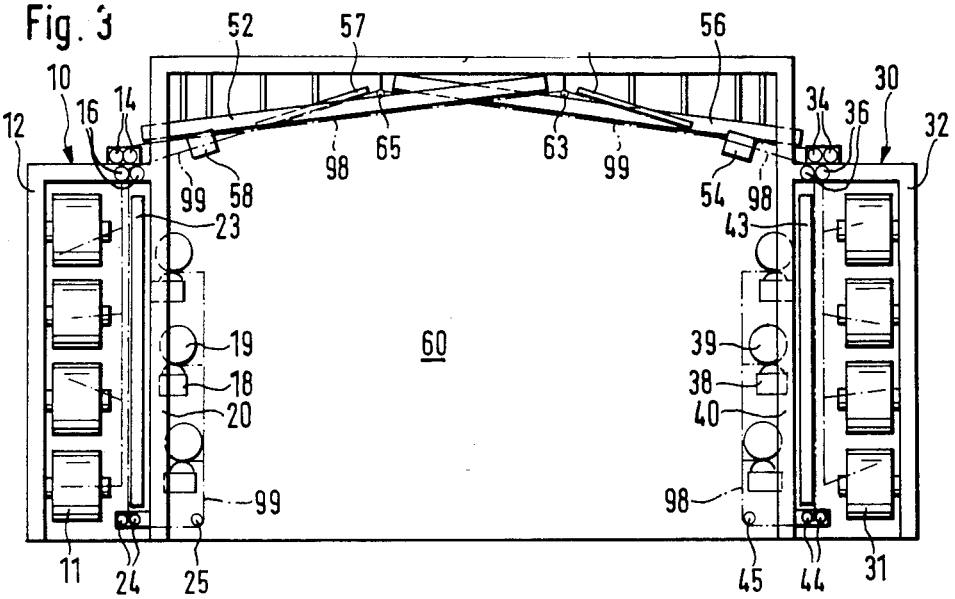
FIG. 3 is a schematic front elevation of a second embodiment of a texturizing machine in accordance with the present invention.

In the embodiment of FIG. 3, a generally horizontal yarn run is also provided, however, the heating tracks 52,56 and the associated cooling plates 53,57 are slightly inclined in opposing directions with deflection guides 63,65 located between the heating tracks 52,56 and the cooling plates 53,57. The selection of the angle of deflection is a function of the particular circumstances. However, it should not exceed 90°, since the false-twist introduced into the texturizing units 54,58 would not be transmitted as well. If, for example, a given machine width is not to be exceeded even though relatively long heating tracks 52,56 and cooling plates 53,57 are required, this can be compensated by the size of the angle.

In FIG. 3, vertically directed heating tubes 23,43 are attached in the two frames 10,30 to the carriers 20,40. The yarns 98,99 are guided through these heating tubes 23,43 after the twist is imparted by the texturizing units 54,58. The heating tubes 23,43 serve to heatset the yarns 98,99. After the heating tubes 23,43, the yarns 98,99 are taken over third feed rolls 24,44 and guided by deflection rollers 25,45 to the bobbin winding units 18,38. The third feed rolls 24,44 are driven in the same manner as the other feeder rolls 14,34 and are synchronized electrically-electronically with them.

Figure 4:
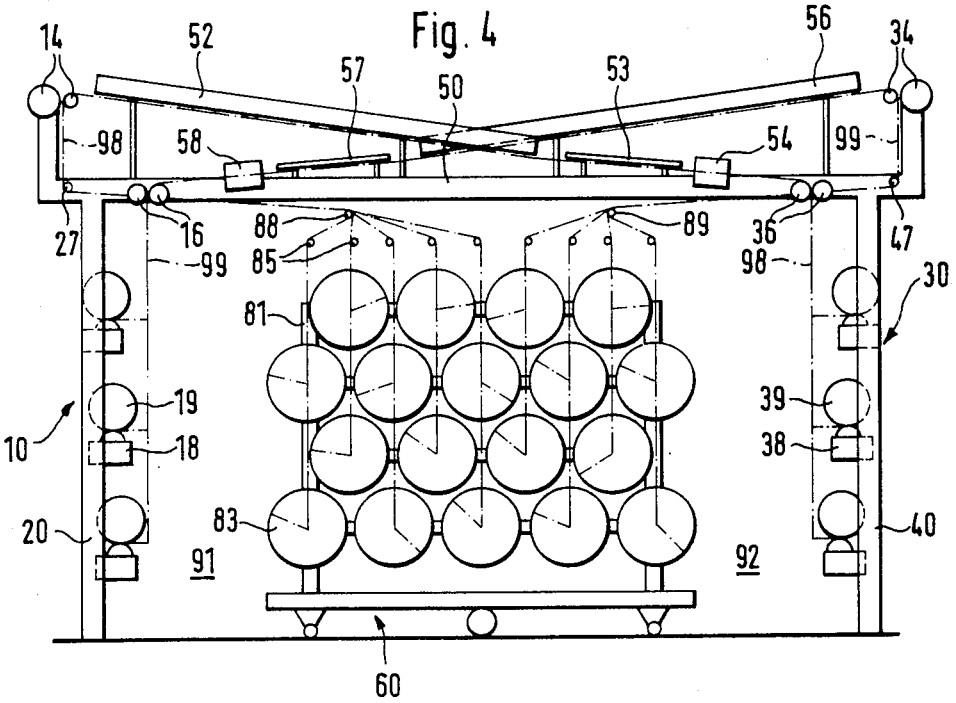
FIG. 4 is a schematic front elevation of a third embodiment of a texturizing machine in accordance with the present invention.

In the texturizing machine of the embodiment of FIG. 4 the frames 10,30 include carriers 20,40, on which the bobbin winding units 18,38 are held. The carriers 20,40 are combined by crossbeams 50 to carrier frames to which the heating tracks 52,56, the cooling plates 53,57, the texturizing units 54,58 and the first and second feed rolls 14,46,34,36 are also attached. The guide of the yarns 98,99 over the passageway 60 defined by the frames 10,30 corresponds to that of FIG. 1.

Creels 81 are located in the passageway 60 of the texturizing machine of FIG. 4 which carry the supply bobbins 83. A passageway 91,92 is left free between the individual creels 81 and the frames 10,30. Likewise, the individual creels 81 are arranged at an interval to each other in the longitudinal direction of the texturizing machine so that an operator can alternate from one passageway 91 to the other passageway 92, e.g. in order to thread a yarn between the creels 81.

As is indicated in FIG. 4, it is possible to mount the individual creels 81 on wheels so that they are movable and can be easily replaced either by an operator or automatically. In the texturizing machine of FIG. 4, the operation and the maintenance of the work elements may be performed from within the passages 91,92 and the sides of the frames 10,30 facing away from the passageway 60 need not be accessible. Thus, several texturizing machines may be positioned back-to-back.

In order to guide the individual yarns 98,99 from the supply bobbins 83 to the first feed rolls 14,34, guides, e.g. deflection rolls 85 and 88,89, are suspended on the carrier frame. Moreover, guides 27,47 are attached to the corner points of the carriers 20,40 and of the crossbeams 50. The yarns 98,99 are guided first from the supply bobbins 83 to the frames 10,30 opposite the associated bobbin winding units 38,18. The bobbin winding units 18,38, feed rolls 14,16,34,36 and the texturizing units 54,58 are driven in the manner described in FIGS. 1 and 2.

It is also possible to provide the texturizing machine of FIG. 4 with an upwardly extending yarn course in the area over the passageway 60 with the aid of appropriate deflection rolls, as was explained in conjunction with FIG. 3. It is also possible to provide heating tubes in accordance with FIG. 3 for setting the yarns in the machine of FIG. 4.

Figure 5:
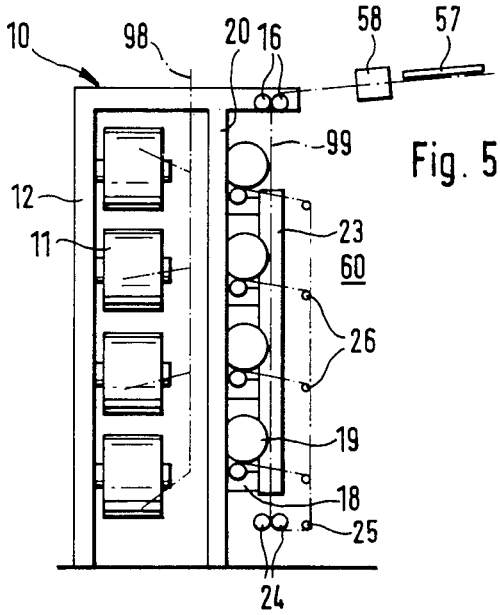
FIG. 5 is a schematic front elevation of one half of a texturizing machine in accordance with the present invention with heatsetting units included.
Figure 6:
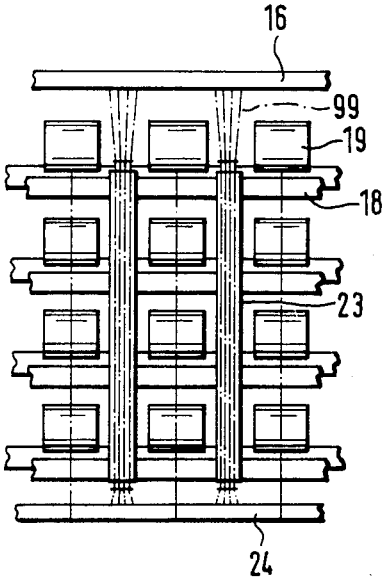
FIG. 6 is a schematic elevation half of the machine shown in FIG. 5 as viewed from within the passageway.

The texturizing machine shown in section in FIGS. 5 and 6 corresponds in its basic design to the machine shown and described above in FIGS. 1 and 2. Therefore, only the differences which distinguish the two machines are explained and the same machine parts are designated by the same reference numerals. It is understood that the machine shown in FIGS. 5 and 6 also consists of two frames with a passageway running therebetween in the longitudinal direction of the machine, as was shown and explained for the machine of FIGS. 1 and 2.

Heatsetting units 23 are provided in the machine shown in section in FIGS. 5 and 6 which units are positioned in the yarn runs of the yarns 99 after the texturizing units 58 and the second feed rolls 16. Starting from the heatsetting units 23, the yarns 99 are guided by third feed rolls 24 and yarn guides 25, 26 to the bobbin winding units 18.

The heatsetting units 23 are arranged approximately vertically and located adjacent the bobbin winding units 18 facing the passageway 60 and between the rows formed by the superjacent bobbin winding unit groups.

In FIGS. 5 and 6, each four superjacent bobbin winding units 18 form a group. The yarns 99 of one group, four yarns in FIGS. 5 and 6, are guided to each heatsetting unit 23.

Other yarn guides are provided between the heatsetting units 23 and the second feed rolls 16 and the third feed rolls 24 which results in a converging of the yarns 99 from the second feeder rolls 16 to the heatsetting units 23 and a diverging of the yarns 99 from the heatsetting units 23 to the third feed rolls 24.

The bobbin winding units 18 together with the winding bobbins 19 and the heatsetting units 23 are mounted on the side of the carrier 20 facing the passageway 60, with an offset arrangement of the bobbin winding units 18 and heatsetting units 23 allowing an operator to reach from the passageway 60 between the heatsetting units 23 to the bobbin winding units 18 in order to change the winding bobbins 19. The heatsetting units 23 can be accessed directly from the passageway 60 for cleaning or maintenance work.

The heatsetting units 23 are located, like the bobbin winding units 18,38, on the frames 10,30 on both sides of the passageway 60 with heatsetting units 23 of one frame 10 located opposite the bobbin winding units 38 on the other frame 30.

The heatsetting units 23 are designed as heating tracks on which the yarns 99 rest. A common heating track is associated with the yarns 99 combined as a group with the yarns 99 resting on the side of the heating tracks facing the passageway 60 or facing away from the passageway 60.

In FIG. 5, the yarn guides 25,26 are located on the side of the heatsetting units 23 facing the passageway 60. Alternatively, these yarn guides 25,26 may be located between the bobbin winding units 18 and the heatsetting units 23 with the result that the courses of the yarns 99 are not located in the area of the passageway 60 and are better protected from damage by an operator.

In a modified embodiment according to FIG. 7, the heatsetting units 23' are designed like heat exchangers which are provided with tubes 23" through which the yarns run without making contact. In another embodiment according to FIG. 8, the tubes 32" of the front side facing the operator passageway are slotted in order to make it easier to thread the yarns in the longitudinal direction with the result that the yarns can be threaded in without having to use an injector or other tool.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A texturizing machine for false-twist crimping of synthetic yarns having a plurality of work stations at each of which yarn is drawn by feed rolls from supply bobbins and guided successively through a heating device, a cooling device and a texturizing unit to a group of superjacent bobbin winding units, with the bobbin winding unit groups being arranged in longitudinal succession along the length of the machine, said machine comprising a pair of opposed spaced longitudinally extending support frames defining an operator service passageway therebetween, said heating devices, cooling devices and texturizing units being disposed adjacent said passageway with said yarn being guided over said passageway, said bobbin winding units being mounted on said opposed frames on both sides of said passageway with said groups of bobbin winding units being mounted in longitudinal sequence with successive bobbin winding unit groups being alternately mounted on opposite frames and with the yarns of successive bobbin winding unit groups being guided in opposite directions over said passageway and successively through said heating devices, cooling devices and texturizing units.

2. A texturizing machine according to claim 1 and characterized further in that each group of bobbin winding units partially overlaps the next longitudinally successive bobbin winding unit group.

3. A texturizing machine according to claim 1 and characterized further in that the supply bobbins for each group of bobbin winding units are mounted on the frame opposite the frame on which the group of bobbin winding units is mounted.

4. A texturizing machine according to claim 3 and characterized further in that the bobbin winding unit groups alternate longitudinally on each frame with the supply bobbins.

5. A texturizing machine according to claim 4 and characterized further in that the supply bobbins and the bobbin winding units on each frame are offset in relation to each other transversally to the longitudinal direction of the machine.

6. A texturizing machine according to claim 3 and characterized further in that the supply bobbins and the bobbin winding units on each frame are offset in relation to each other transverselly to the longitudinal direction of the machine.

7. A texturizing machine according to claim 6, and characterized further in that said frames have sides facing outwardly away from said passageway and said supply bobbins are mounted on said outwardly facing sides of the frames.

8. A texturizing machine according to claim 3 and characterized further in that said frames have sides facing outwardly away from said passageway and said supply bobbins are mounted on said outwardly facing sides of the frames.

9. A texturizing machine according to claim 3 and characterized further in that said opposed frames are spaced apart a distance corresponding approximately to the effective combined transverse extent of said heating devices, said cooling devices and said texturizing units.

10. A texturizing machine according to claim 3 and characterized further in that said heating device, cooling device and texturizing unit of each work station are disposed at least approximately in a linear series.

11. A texturizing machine according to claim 3 and characterized further in that said heating device, said cooling device and said texturizing unit extend generally horizontally.

12. A texturizing machine according to claim 1 and characterized further in that the supply bobbins are mounted in said passageway and the yarns are guided from the supply bobbins to the side of the passageway opposite the associated bobbin winding units and are subsequently guided over the passageway to the associated bobbin winding units.

13. A texturizing machine according to claim 12 and characterized further by movable creels for mounting the supply bobbins in said passageway.

14. A texturizing machine according to claim 12 and characterized further in that said opposed frames are spaced apart a distance corresponding approximately to the effective combined transverse extent of said heating devices, said cooling devices and said texturizing units.

15. A texturizing machine according to claim 12 and characterized further in that said heating device, cooling device and texturizing unit of each work station are disposed at least approximately in a linear series.

16. A texturizing machine according to claim 12 and characterized further in that said heating device, said cooling device and said texturizing unit extend generally horizontally.

17. A texturizing machine according to claim 1 and characterized further in that said opposed frames are spaced apart a distance corresponding approximately to the effective combined transverse extent of said heating devices, said cooling devices and said texturizing units.

18. A texturizing machine according to claim 1 and characterized further in that said heating device, cooling device and texturizing unit of each work station are disposed at least approximately in a linear series.

19. A texturizing machine according to claim 1 and characterized further in that said heating device, said cooling device and said texturizing unit extend generally horizontally.

20. A texturizing machine according to claim 1 and characterized further in that said bobbin winding units are arranged in horizontal rows and by common drive means, with the drive means for the bobbin winding units in vertically adjacent rows being connected by an electrical-electronic synchronization control.

21. A texturizing machine according to claim 1 and characterized further by a common drive means for the linearly adjacent feed rolls on each side of said machine.

22. A texturizing machine according to claim 21 and characterized further in that the drive means of the feed rolls at each work station are synchronized with each other in speed by an electrical-electronic control.

23. A texturizing machine according to claim 1 and characterized further in that each said texturizing unit comprises an individual drive motor synchronized with the drive motors of other texturizing units by an electrical-electronic control.

24. A texturizing machine according to claim 1 and characterized further by heatsetting units located in the path of the yarns following the texturizing units, said heatsetting units being disposed on said frames on both sides of the passageway and extending approximately vertically.

25. A texturizing machine according to claim 24 and characterized further in that said heatsetting units are mounted on said bobbin winding units adjacent the passageway.

26. A texturizing machine according to claim 25 and characterized further in that said heatsetting units are located between the groups of superjacent bobbin winding units.

27. A texturizing machine according to claim 26 and characterized further in that the yarns for each group of bobbin winding units are associated with a common heatsetting unit.

* * * * *